US007207417B2

(12) United States Patent
Blount

(10) Patent No.: US 7,207,417 B2
(45) Date of Patent: Apr. 24, 2007

(54) METHOD OF CHANGING ENGINE OIL

(76) Inventor: John Blount, P.O. Box 1631, Jupiter, FL (US) 33468

( * ) Notice: Subject to any disclaimer, the term of this patent is extended or adjusted under 35 U.S.C. 154(b) by 618 days.

(21) Appl. No.: 10/668,070

(22) Filed: Sep. 22, 2003

(65) Prior Publication Data

US 2005/0115769 A1 Jun. 2, 2005

(51) Int. Cl.
*F16C 1/14* (2006.01)

(52) U.S. Cl. ..... 184/1.5; 123/196 R

(58) Field of Classification Search ..... 184/1.5, 184/6.21, 6.24, 55.1; 123/196 A, 196 R
See application file for complete search history.

(56) References Cited

U.S. PATENT DOCUMENTS 4,524,733 A * 6/1985 Schmidt ..... 123/196 A
4,951,784 A * 8/1990 Bedi ..... 184/1.5
5,070,831 A * 12/1991 Yunick ..... 123/196 A
5,168,844 A * 12/1992 Waelput ..... 123/196 A
5,190,120 A * 3/1993 Watts ..... 184/1.5
5,246,086 A * 9/1993 Yunick ..... 184/1.5
5,743,231 A * 4/1998 Reinosa ..... 123/196 S
5,775,385 A * 7/1998 Tackett, Sr. ..... 141/98
5,787,372 A * 7/1998 Edwards et al. ..... 701/29
6,089,205 A * 7/2000 Grigorian et al. ..... 123/196 A
6,298,947 B1 * 10/2001 Flynn ..... 184/1.5
2004/0020720 A1 * 2/2004 Flynn ..... 184/1.5
2006/0032709 A9 * 2/2006 Waelput ..... 184/1.5

* cited by examiner

*Primary Examiner*—David M. Fenstermacher
(74) *Attorney, Agent, or Firm*—David W. Barman; Robert M. Schwartz

(57) ABSTRACT

A method for converting an engine from petroleum based engine oil to synthetic oil, whereby substantially all petroleum based engine oil is removed prior to replacement with synthetic engine oil.

6 Claims, 6 Drawing Sheets

METHOD OF CHANGING ENGINE OIL

BACKGROUND OF THE INVENTION

The internal combustion engine has been around since the late 18$^{th}$ century. Since its inception, there has been a continual attempt to improve not only the engine, but also the means to keep it maintained. One area where there is a constant need for engine maintenance is the repetitive changing of the oil. Many amateur and professional mechanics have devised numerous products and processes to make the needed oil change an easier and more efficient process. There are numerous patented devices that have attempted to improve on the oil change process. One area that has been neglected, is a system suited for changing the oil in a motorcycle engine.

V Twin motorcycle engines have been around since the early 1900's. Since then engineering in motorcycle engines has produced great advances. One such advance has been the development of a "High Tech, Light Weight, High Horsepower Engine" (hereinafter HT engine). With the development of the HT engine comes the need for engine oil particularly suited for the high heat/low friction environment within the HT engine. Numerous synthetic oils have been developed to be used in the HT engines. The problem that arises is when a motorcycle user or mechanic wishes to change from petroleum-based oil to synthetic oil. This change is particularly problematic especially when made during the engine "break in" period, which is typically the first 5000 miles of engine use. Standard petroleum based engine oil builds up a varnish from the heated oil, sludge, and metal particles which breakdown from oil at high temperatures. Synthetic engine oils are engineered to have very little wear and very high lubrication properties. Many motorcycle mechanics agree that synthetic oil is not suitable for use during the "break in" period. A preferred method of breaking in the engine is to begin with petroleum based oil and subsequently change to a synthetic oil. When switching to the synthetic oil after the break-in period, the synthetic oil is invariably contaminated with residual petroleum engine oil that has remained in the engine. A mixture of the contaminated petroleum and synthetic oils will cause excessive burning of the synthetic oil because the rings will not seat on the cylinder walls due to varnish build up. The build up will cause poor compression, higher fuel consumption, and reduced engine performance. There is a need for a system for changing from petroleum to synthetic engine oil where a complete change is made and the synthetic engine oil is completely installed as a replacement.

SUMMARY OF THE INVENTION

The present invention is particularly suited for effectively performing and completing the conversion from petroleum based to synthetic engine oil.

It is an object of the present invention to provide a system for changing engine oil such that substantially all petroleum based engine oil is removed and replaced with synthetic engine oil.

It is further an object of the present invention to provide for a system for changing engine oil on a High Tech V Twin motorcycle engine.

It is further an object of the present invention change the engine oil in a manner such that containments such as varnish, sludge and metal particles are removed.

DETAILED DESCRIPTION OF THE PREFERRED EMBODIMENTS

The system of the present invention relates to a system for changing an engine from petroleum based engine oil to a synthetic oil. In a preferred embodiment, the system is particularly suited for use with a motorcycle. An even more preferred embodiment utilizes the system on a motorcycle with a V twin engine. The term "synthetic oil" as used herein is meant to encompass engine lubricants that comprise a majority of volume that is not petroleum based. Typically, this is more than 50% of the w/v being a non-petroleum composition. In a preferred embodiment, the system for changing the engine oil comprises using a lubricant that is substantially 100% synthetic in composition. This includes compositions that are 100% synthetic lubricants. The term "oil muzzle" refers to the article which will attach to the oil filter housing on one end, and have receiving orifices on the opposite end for receiving inlet/outlet means by which the old oil will be removed and a new oil will be introduced to the engine.

Figure 1:
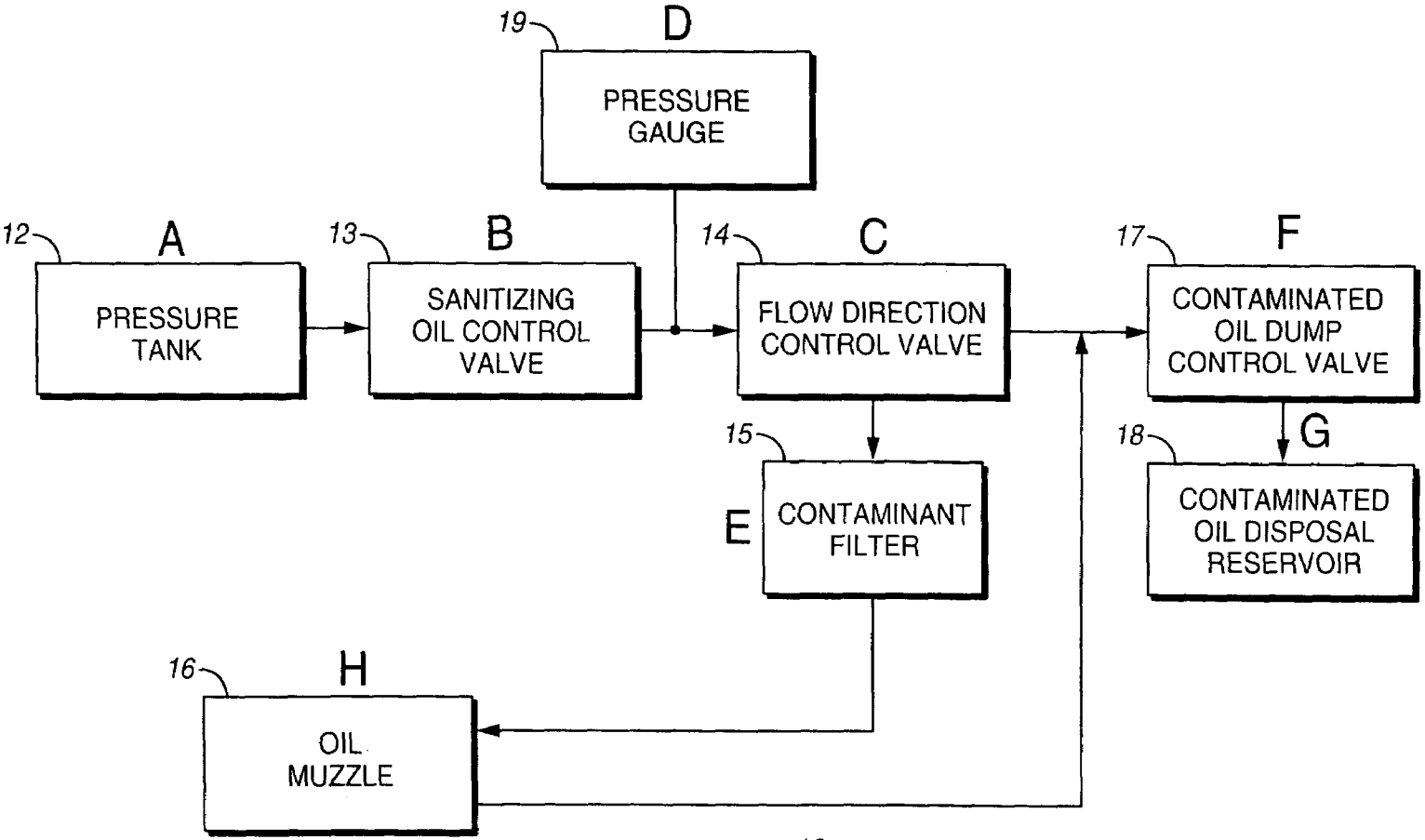
FIG. 1 is a flow chart diagramming the system by which the engine oil change and conversion takes place.
Figure 2:
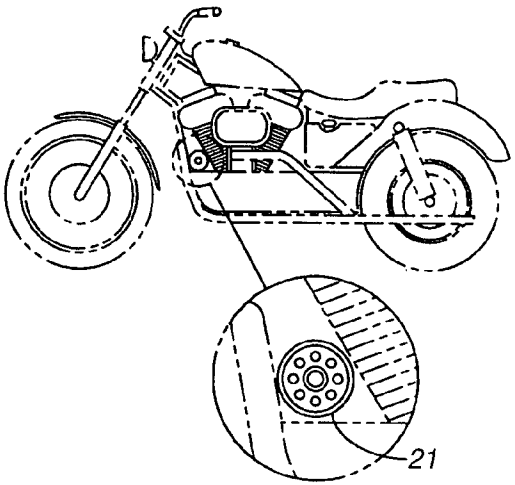
FIG. 2 shows the location of the oil filter on a standard V Twin Motorcycle engine.
Figure 3:
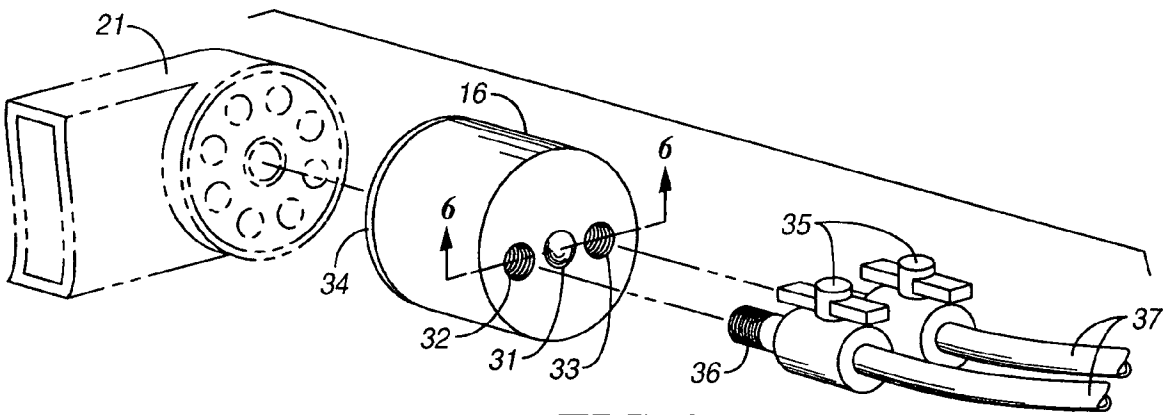
FIG. 3 shows a housing called an "oil muzzle" which is placed over the opening where the oil filter connects to the engine.
Figure 4:
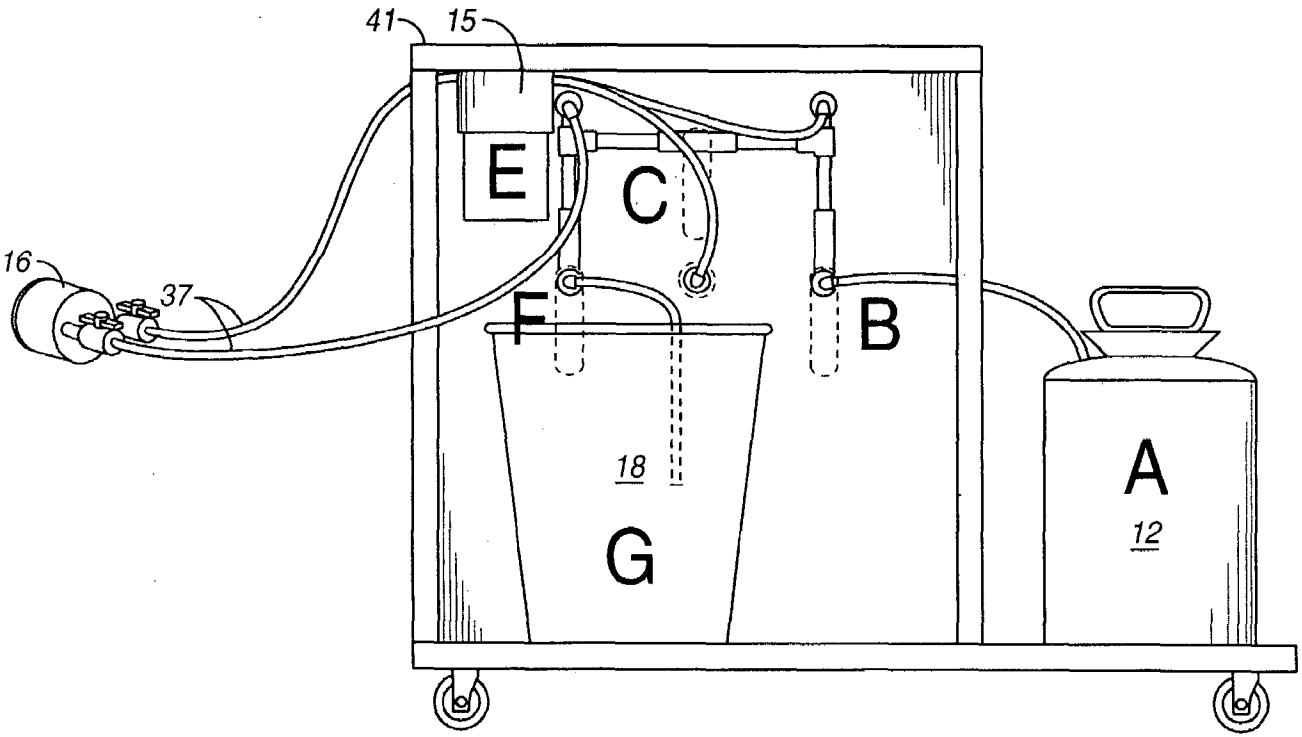
FIG. 4 shows the arrangements of the various components of the system.
Figure 5:
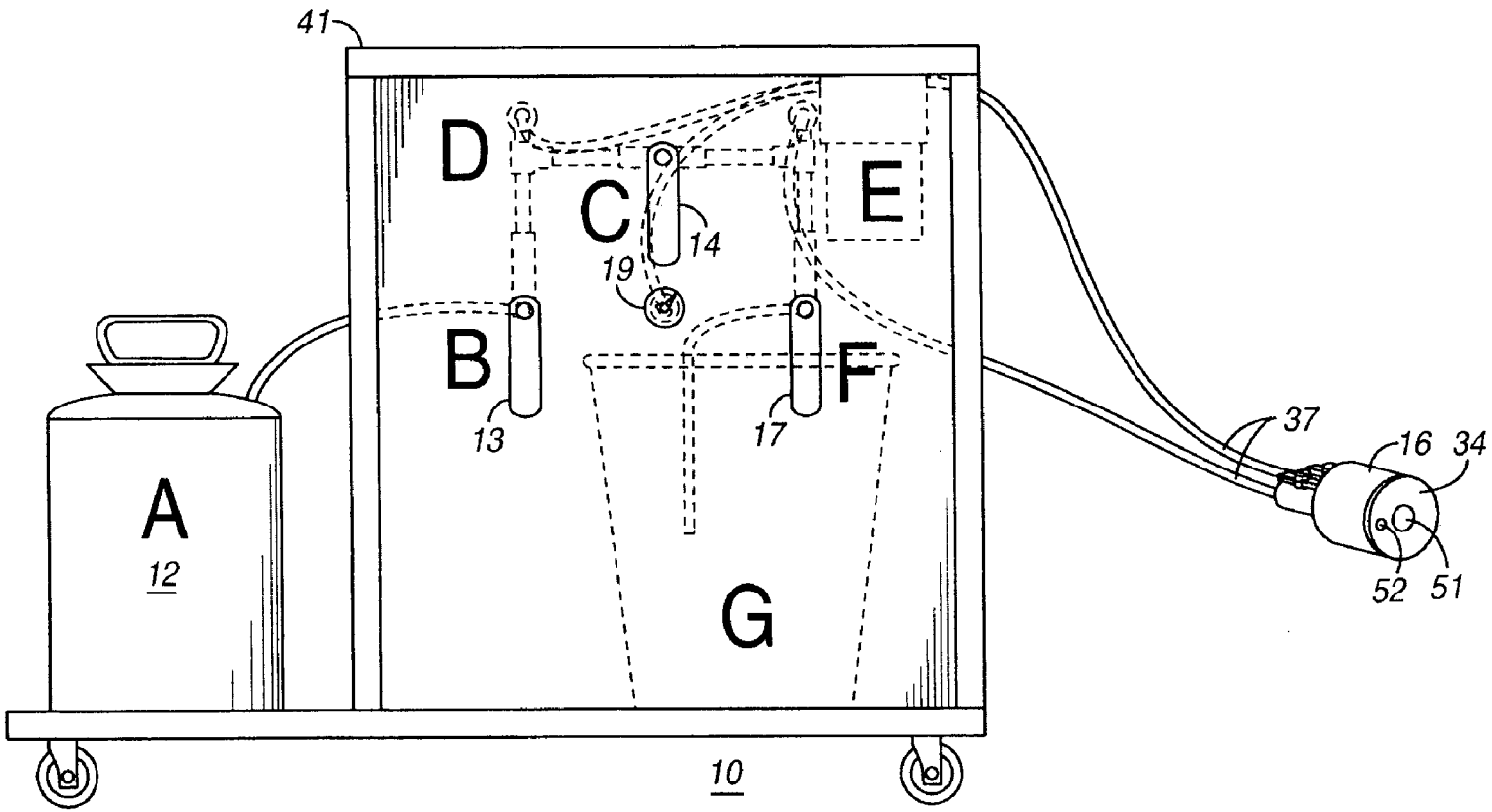
FIG. 5 shows a further arrangement of the various components of the system.
Figure 6:
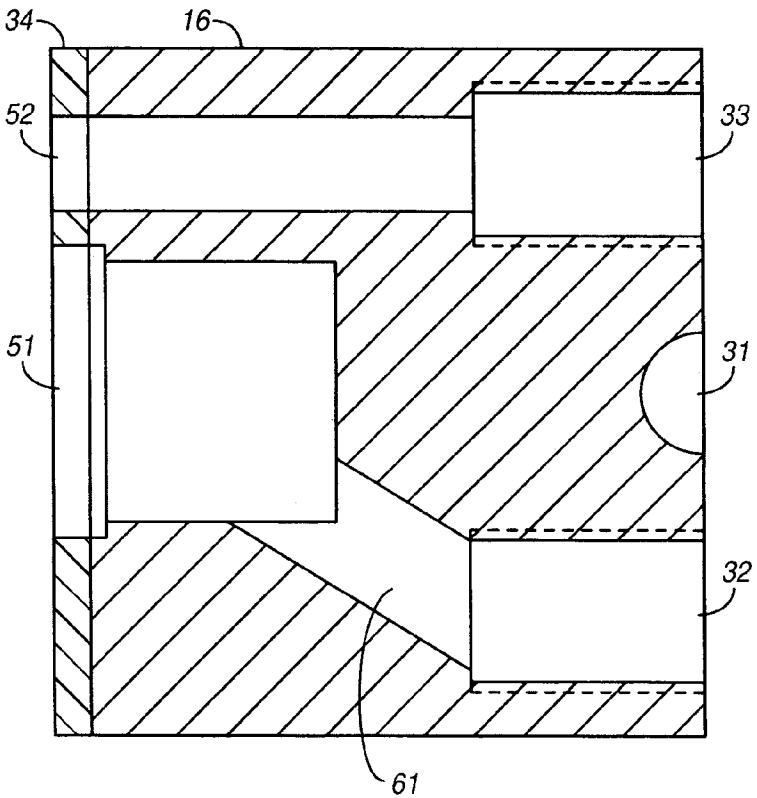
FIG. 6 shows the oil muzzle prior to connection.
Figure 7:
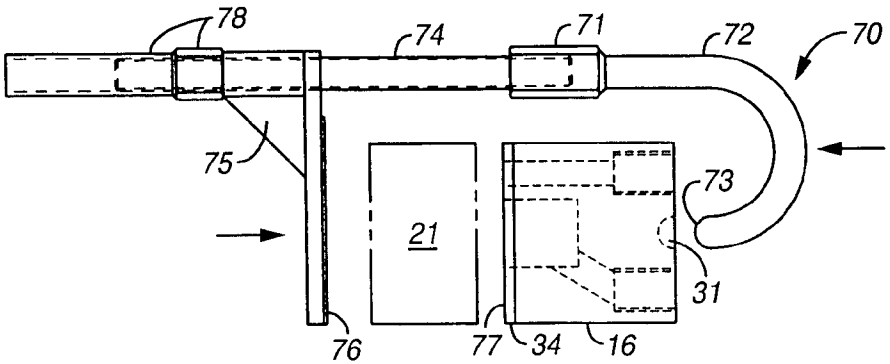
FIG. 7 shows the connected oil muzzle.
Figure 8:
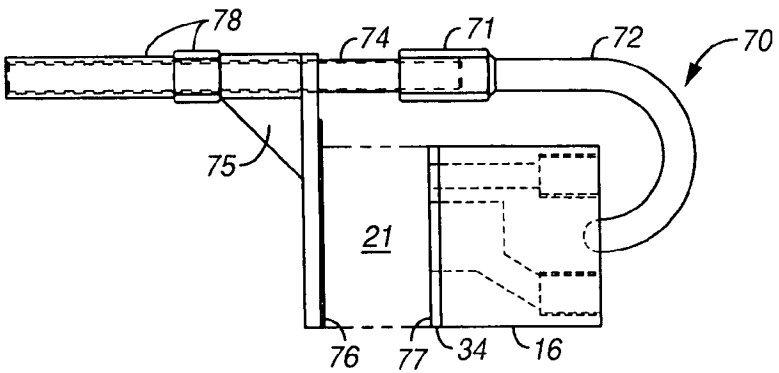
FIG. 8 shows the connected oil muzzle secured into place on a housing by an engaged clamp.

FIG. 1. is a flowchart that details the steps of the process. FIG. 2 shows a motorcycle with the oil filter housing 21 shown in enlarged view. FIG. 3 shows the arrangement of the oil muzzle 16 and alignment with oil filter housing 21. The oil muzzle 16 has secure to it, on one end, a gasket 34. The gasket may be of any composition known in the art that will be resistant to any reactions with engine lubricant and will provide a substantially air-tight seal between the oil muzzle 16 and the oil filter housing 21 when the muzzle is joined to the housing and secured in place. The lateral surface 6 has an indented area 31 which is a clamping dimple. Orifices 32 and 33 are NPT ports that will receive each of two NPT nipples 36 that are attached to each of two valves 35 that are in turn connected to each of two hoses 37. FIG. 4 shows the overall configuration of the system 10. The system comprises a pressure tank 12 and internal component contained within a housing 41. Said housing having affixed a containment filter 15 and a contaminated oil reservoir 18. FIG. 5 shows the overall configuration of the system 10 wherein in this figure, the view is of the outside of the housing 41 whereby the user accesses sanitizing control valve 13, flow direction control valve 14, contaminated oil dump control valve 17 and monitors the system on pressure gauge 19. FIG. 5 also show oil muzzle 16 gasket that will connect to the oil filter housing. The oil muzzle 16 has formed two orifices 51 and 52 on the surface containing the gasket 34. Orifice 51 will act as an inlet to allow new engine oil to flow through oil muzzle 16 into the engine. Orifice 52 will receive removed oil exiting the engine. FIG. 6 is a cross section of oil muzzle 16 showing clamping dimple 31 conversion oil port 32 that is connected to angled channel 61 which connects conversion oil port 32 with inlet port 51. Further shown is Engine oil port 33 which is connected to outlet port 52. FIG. 7 shows the oil muzzle 16 prior to being attached to oil filter housing 21. A unique feature of oil muzzle 16 is that is connects to oil filter housing 21 without screw threads. In other words, oil muzzle 16 does not screw onto oil filter housing 21, as would a conventional oil filter. Clamp 70 is positioned such that spherical locating tip 73 contacts oil muzzle 16 at clamping dimple 31. The U shaped end 72 of clamp 70 attaches to a connector 71, which is a threaded nut. The connector 71 receives threaded shaft 74 and treaded shaft 74 is further connected to a second connector 78 which is also a threaded nut that further comprises a grip sleeve. Clamping bracket 75 secures the grip sleeve 78 to plate 76. FIG. 8 shows the oil muzzle 16 secured into place on housing 21 by tightening connectors and 78 by which the distance between shaft 74 and U shaped clamp end 72 is reduced, and the oil muzzle 16 is help into place through the force exerted where spherical locating tip 73 contacts oil muzzle 16 at clamping dimple 31.

The motorcycle is secured in place in any acceptable manner. The oil filter is removed and after removal, the drain plug for the oil reservoir is removed. The oil muzzle is secured into place on the oil filter housing in the spot that holds the filter. The oil muzzle is not threaded, as are conventional oil filters. Instead, the oil muzzle is secured into place with the clamp as shown in FIGS. 6 and 7. The valves 35 on the hoses immediately adjacent to the oil muzzle, as shown in FIG. 3, are opened. Prior to commencing the process, sanitizing oil control valve 13 and contaminated oil dump control valve 17 and flow direction control valve 14 should be closed.

The pressure tank 12 is filled with synthetic engine oil. The top of tank 12 has a handle that is raised vertically and lowered which pumps air into the tank and pressurizes the system. Operator raises and lowers the pump handle on top of tank 12 several times until the pressure gauge shows approximately 35–40 psi. Once system is pressurized, open sanitizing oil control valve 13 and contaminated oil dump control valve 17. Visually monitor the oil exiting the oil reservoir. When operator views the oil to be sufficiently clean, the drain plug is replaced into the oil reservoir. Allow system to fill reservoir until the engine oil dipstick indicates the reservoir is full. Once the reservoir is full turn off sanitizing oil control valve 13 and open flow direction control valve 14. Start the motorcycle and monitor the clarity of the oil exiting the system into the contaminated oil disposal reservoir 18. Once the oil entering the contaminated oil disposal reservoir 18 is sufficiently clean close contaminated oil dump control valve 17 and allow the engine to idle for 15–20 minutes.

Remove the drain plug and allow the oil to drain. The oil muzzle is removed by loosening the screw connectors 71 and 78 on clamp 70. Place a new oil filter on the filter housing. Replace the drain plug and fill the reservoir with synthetic engine oil.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A method for converting an engine from petroleum based engine oil to synthetic oil, said method comprising the steps of: (a) Removing oil filter from oil filter housing; (b) Removing engine oil drain plug; (c) draining engine oil through said drain plug orifice; (d) attaching an oil muzzle, which comprises two orifices and a clamping dimple on a lateral surface, to an oil filter housing by engaging a clamp at said clamping dimple with a locating tip of a clamp and a plate portion against a posterior region of said filter housing, and further wherein said clamp secures said oil muzzle into position without screw threads; (e) flushing engine oil with replacement synthetic oil.

2. The method of claim 1 wherein said engine is a motorcycle engine.

3. The method of claim 1 wherein said engine is a V twin motorcycle engine.

4. The method of claim 1 wherein said draining engine oil comprises draining petroleum based engine oil.

5. The method of claim 1 wherein said oil converting apparatus comprises (a) a means for pressurizing said apparatus; (b) a reservoir for holding synthetic replacement oil; (c) valves to control direction of oil exiting and entering the apparatus; and (d) a reservoir for capturing contaminated oil.

6. The method of claim 1 wherein said flushing of engine oil comprises the steps of; (a) observing flush oil from drain plug orifice until said oil is substantially clean; (b) replacing drain plug; (c) observing flush into oil converting apparatus contaminated oil reservoir until said oil is substantially clean; (d) closing apparatus valves; (e) start the motorcycle and allow motorcycle to idle; (f) draining engine oil by removing oil plug; (g) disconnecting oil muzzle; (h) replacing oil plug (i) securing oil filter to said filter housing; and (j) filling engine oil reservoir with synthetic engine oil.

* * * * *